US005568824A

United States Patent [19]

Cordrey

[11] Patent Number: 5,568,824

[45] Date of Patent: Oct. 29, 1996

[54] HOSE REEL

[76] Inventor: Michael P. Cordrey, Rte. 1, Box 4066A, Delmar, Del. 19940

[21] Appl. No.: 530,445

[22] Filed: Sep. 19, 1995

[51] Int. Cl.[6] ..... B65H 75/34

[52] U.S. Cl. ..... 137/355.27; 137/355.16; 137/355.23; 137/334

[58] Field of Search ..... 137/355.16, 355.19, 137/355.2, 355.23, 355.26, 355.27, 334; 239/197, 198

[56] References Cited

U.S. PATENT DOCUMENTS

| | | | |
|---|---|---|---|
| 1,034,285 | 7/1912 | Olsson . | |
| 1,537,637 | 5/1925 | Jarvis . | |
| 1,740,748 | 12/1929 | Read | 137/355.26 XR |
| 1,881,764 | 10/1932 | Ludwig | 137/355.26 |
| 2,193,288 | 3/1940 | Liley . | |
| 2,742,242 | 4/1956 | Godwin . | |
| 3,199,529 | 8/1965 | Fracassi | 137/355.26 |
| 3,255,771 | 6/1966 | MacSpadden | 137/355.27 XR |
| 3,457,946 | 7/1969 | Dean, Jr. et al. . | |
| 3,939,862 | 2/1976 | Booth . | |
| 4,582,257 | 4/1986 | Siegler . | |
| 5,119,843 | 6/1992 | Keenan | 137/355.23 |
| 5,392,808 | 2/1995 | Pierce | 137/355.23 |

FOREIGN PATENT DOCUMENTS

| | | |
|---|---|---|
| 63-106279 | 5/1988 | Japan . |
| 166012 | 2/1934 | Switzerland . |
| 445369 | 4/1936 | United Kingdom . |

*Primary Examiner*—Kevin Lee
*Attorney, Agent, or Firm*—Richard C. Litman

[57] ABSTRACT

A hose reel includes a housing or casing therefor, providing for the concealed installation of the reel within the ground or within a basement or foundation crawl space. A hose access and control panel is also provided, with the panel and a cover therefor being the only components of the reel which are exposed to the elements. The reel may include automatic retraction using an elastic (i.e., bungee) cord, and may also include a remotely operated water flow and shutoff solenoid valve and manually or automatically switched electrical heating element. The reel assembly may be mounted on tracks within the housing, in order that the reel assembly may be removed for maintenance and repair as required. The concealed hose reel and housing serves to protect the hose thereon from damage or theft when not in use, and eliminates the need for any unsightly or inconvenient externally mounted hose rack or reel.

14 Claims, 3 Drawing Sheets

HOSE REEL

FIELD OF THE INVENTION

The present invention relates generally to retracting and storage devices for hoses and the like, and more specifically to a mechanized reel which may be installed beneath the surface of a yard or other area, or alternatively within the foundation crawl space or basement of a structure. The reel includes a housing and automatic retraction means, as well as electrical means for controlling water flow and selectively heating the storage space to prevent freezing.

BACKGROUND OF THE INVENTION

One or more garden or watering hoses ore nearly universal pieces of household equipment, and the problem of storing such a flexible, elongate, and cumbersome article is also as universal as the article itself. As a result, numerous devices have been developed for hose storage over the years, ranging from a simple spike in a wall, post, or the like from which the coiled hose may be hung, to more elaborate stationary racks and revolving reels.

In each of the above cases, the hose is still generally stored outdoors, where it detracts from the decor and is vulnerable to theft or other damage. Moreover, generally the hose storage means along one wall of the home, where the hose may be difficult to reach if foundation plantings have been made. While the hose may alternatively be stored indoors, the retrieval of the hose from its indoor storage area and deployment out of doors, and the reversal of the procedure when the task is completed, unnecessarily complicate the task.

Accordingly, a need will be seen for a hose reel system which may be permanently installed in a readily accessible location, but which also serves to protect the hose while in storage and to provide an unobtrusive storage means. The reel system and housing may be installed beneath the surface, as in a lawn or other planted area, with only a relatively small access panel being located at the surface. Alternatively, the reel may be installed in a basement or foundation crawl space area, with the small access panel being located in a foundation wall. Other features, such as a retracting mechanism, an electrical water supply shutoff solenoid valve, and/or heating means to prevent freezing, may also be provided as desired.

DESCRIPTION OF THE PRIOR ART

U.S. Pat. No. 1,034,285 issued to Arthur L. Olsson on Jul. 30, 1912 describes an Automatic Hose Reel wherein the reel is disposed beneath the floor of a house. No alternative location for the reel is disclosed by Olsson, nor is any anticipated by Olsson, as no housing for the hose and reel is provided in order to protect the assembly in an underground location. In any case, Olsson does not disclose any remote water control valve or heating means, electrical or otherwise, as provided by the present invention.

U.S. Pat. No. 1,537,637 issued to Clifford A. Jarvis on May 12, 1925 describes a Self Reeling Hose Reel, with the reel being portably mounted on a wheeled cart. The hose is temporarily connected to a fixed water supply, rather than remaining connected at all times in a fixed reel configuration. Again, no remote water control valve or heating means is disclosed, electrical or otherwise.

U.S. Pat. No. 2,193,288 issued to Richard Liley on Mar. 12, 1940 describes a Hose Reel having a vertical axis, wherein the hose is wound in a single horizontal plane. The device is adapted for use in the foundation crawl space of a structure, where vertical room is limited. However, the winding retraction of the hose in a single plane, results in a relatively large diameter reel which may not clear adjacent vertical structures. As in the prior art discussed above, Liley provides no remote water control valve or heating means, electrical or otherwise, for his hose reel.

U.S. Pat. No. 2,742,242 issued to James R. Godwin on Apr. 17, 1956 describes an Automatically Retrieving Floating Reel, wherein a portable wheeled reel is secured to the approximate center of a hose and provides for the simultaneous unwinding of the hose from both sides of the center. Due to the wheeled nature of the portable reel, the rewinding function is not apparent, as the reel base is free to rotate about the wheels, rather than remaining fixed while the reel retracts the hose. In any case, the device is not a permanent installation, nor is any remote water control valve or heating means disclosed, as provided by the present invention.

U.S. Pat. No. 3,457,946 issued to Raiford P. Dean, Jr. et al. on Jul. 29, 1969 describes a Hose Reel In Container, adapted for installation behind or within a bathroom wall or the like for indoor use. The retractable and extendible hose is used for a shower spray and is controlled by the conventional tub diverter valve. However, the water flow through the device is reversed from the conventional, in that water flow passes through a fixed inlet into the housing and floods the housing interior, with the retractable and extendible hose being sealed at its outlet from the housing. No electrical heating or water control means is disclosed.

U.S. Pat. No. 3,939,862 issued to William M. Booth on Feb. 24, 1976 describes a Hose Reel which uses fluid pressure for operating a rewind mechanism and which automatically shuts off the water supply to the hose and drains the hose after it has been rewound. The device is a relatively complex hydraulic system, using a plurality of parallel spool valves and a motor operated by water flow through the system. The device also requires a vertical axis for the reel and a precise mechanism for rewinding the hose on the reel, so that there will be a continual downward slope in the hose to provide for draining the hose after use. The result is a relatively complex and expensive device in comparison to the present system, and Booth still makes no provision for heating or electric water control, nor for concealed installation, as provided by the present invention.

U.S. Pat. No. 4,582,257 issued to Frederick Siegler on Apr. 15, 1986 describes a Sprinkler Hose With Self Winding Capability, wherein a perforated hose is extendible from and retractable onto a portable reel. The inlet end, rather than the outlet end, of the hose is remotely located from the reel when the hose is extended. No permanent installation, housing, or remote shutoff or heating means is disclosed by Siegler.

Swiss Patent Publication No. 166,012 to Ernst Weber and published on Feb. 16, 1934 describes a hose reel which is pivotally mounted on a wall. The pivot axis is vertical, while the reel axis is horizontal. No housing, remote water control means, or heating means is disclosed, nor is any concealed installation provided wherein the reel is behind a wall with the hose being extendible and retractable through a passage in the wall, as provided by the present invention.

British Patent Publication No. 445,369 to Charles Winn & Co. Ltd. and accepted on Apr. 8, 1936 describes Improvements In Or Relating To Hose Reels, comprising a guide which is mounted adjacent to the reel to allow the hose to be withdrawn from the reel at any angle thereto without kinking. No housing or concealed installation is disclosed, and in fact would be undesirable in the case of the Winn & Co. disclosure, as the device is directed to use with an emergency fire hose which must be readily accessible and in plain sight at all times. Moreover, no remotely actuated water control means or heating means is disclosed by Winn & Co., as provided by the present invention.

Finally, Japanese Patent Publication No. 63-106,279 to Satoshi Yoshimura and published on May 11, 1988 describes an Automatic Winding Device For Piping, wherein a coiled spring is installed within the winding drum. The liquid supply line appears to run through the center of the winding drum to form an axle, with a radially disposed pipe provided on one side of the drum and connecting to one end of the flexible hose wound on the drum, by passing through the side of the drum. Other than the rewind spring which is coiled about the axle of the reel, the Yoshimura device does not appear to be relevant to the present invention. Yoshimura does not appear to provide for any surrounding structure in order to bury the device within the ground, nor for any remote water shutoff or heating means, as provided by the present hose reel.

None of the above noted patents, taken either singly or in combination, are seen to disclose the specific arrangement of concepts disclosed by the present invention.

SUMMARY OF THE INVENTION

By the present invention, an improved hose reel is disclosed.

Accordingly, one of the objects of the present invention is to provide an improved hose reel which includes a case or housing therearound and which is adapted for concealed installation within the ground or within a basement or foundation crawl space.

Another of the objects of the present invention is to provide an improved hose reel which may include automatic retraction means.

Yet another of the objects of the present invention is to provide an improved hose reel which may include remotely actuated water control valve means therewith.

Still another of the objects of the present invention is to provide an improved hose reel which may include remotely and/or automatically actuated heating means therewith.

An additional object of the present invention is to provide an improved hose reel which water control and heating means are electrically controlled.

A further object of the present invention is to provide an improved hose reel which may be removed from its housing for maintenance and repair, as required.

A final object of the present invention is to provide an improved hose reel for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
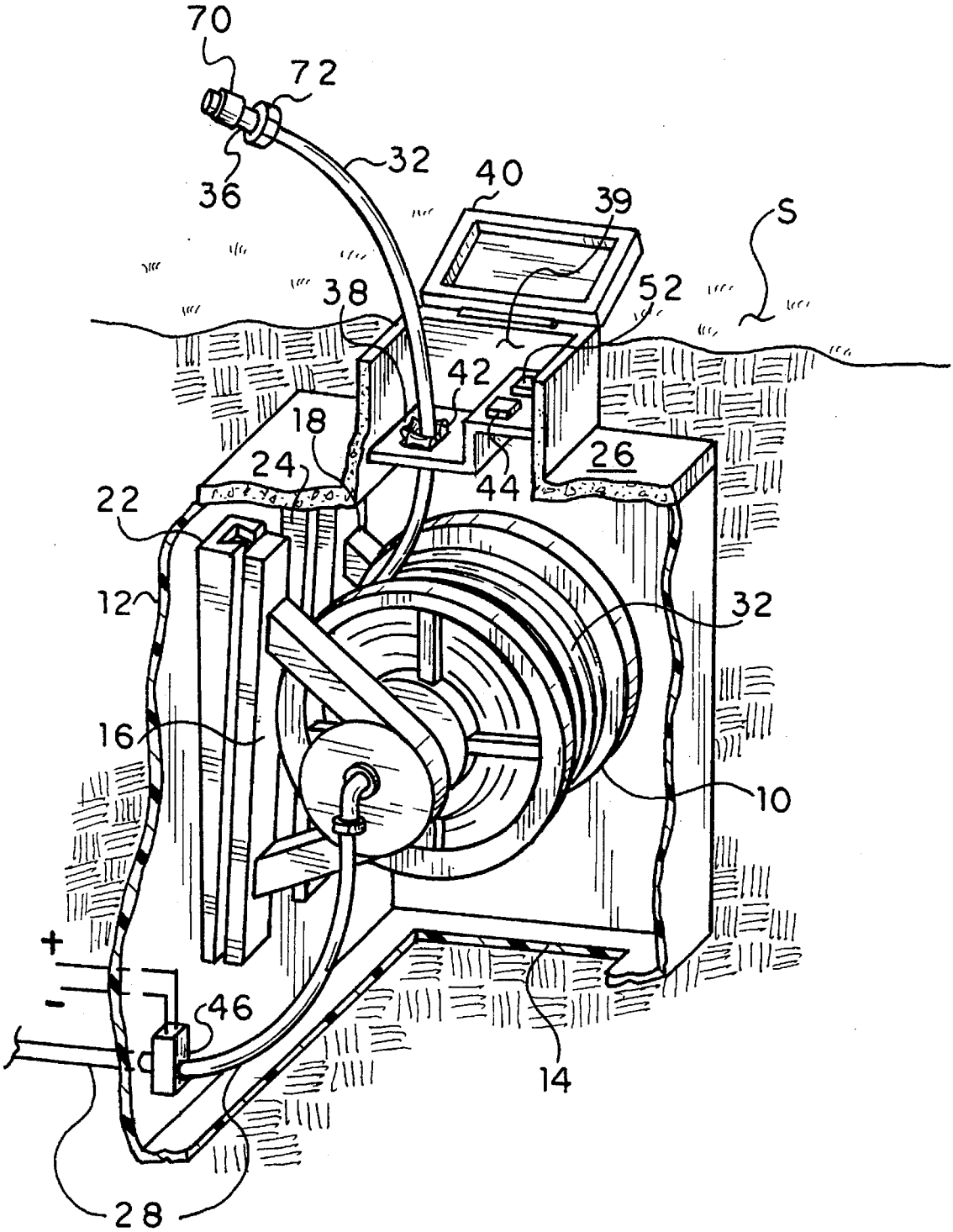
FIG. 1 is a broken away perspective view of the present hose reel and case or housing therefor, showing an underground installation.
Figure 2:
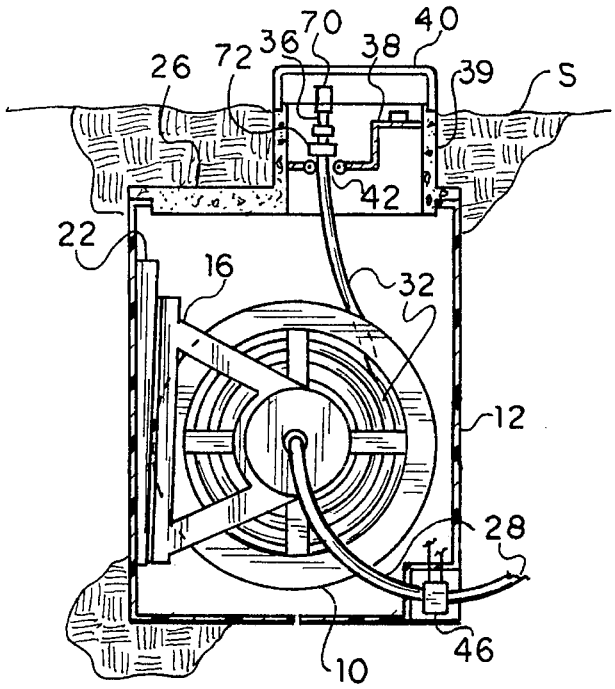
FIG. 2 is a side elevation view of the hose reel of FIG. 1, having a slightly different arrangement of components.

Referring now to the drawings, the present invention will be seen to relate to a concealed and protected hose reel which is removably mounted within a housing, with the housing being permanently installed in a concealed location, e.g., beneath the surface of the terrain, as shown in FIGS. 1 and 2, or within the foundation space (basement or crawl space) of a building structure. Only an access and control panel is indirectly exposed, with a cover being provided for the panel to preclude direct exposure of the panel to the elements.

Figure 5:
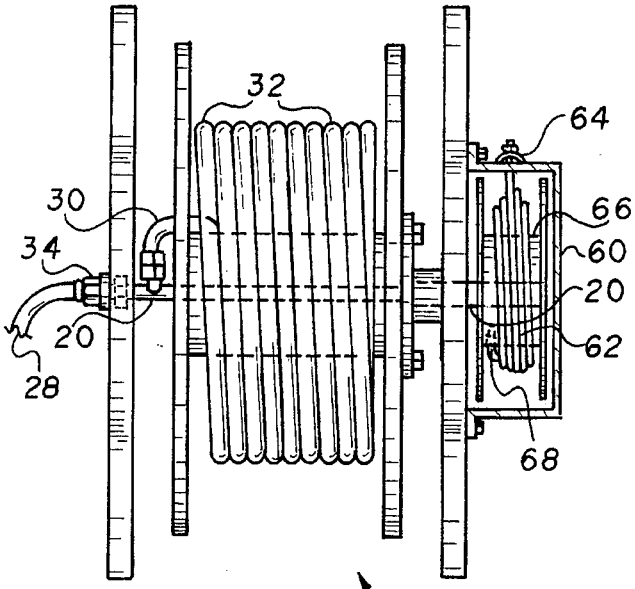
FIG. 5 is an elevation view in section of the present reel, showing details of the retraction mechanism therefor.

In FIGS. 1 and 2, a hose reel 10 is removably installed within a housing 12, which housing 12 is buried beneath the surface S of the terrain (residential yard, etc.). (It will be understood that the housing 12 completely encloses the reel 10, with the exception of a bottom opening 14 for drainage, and that it is shown partially broken away in FIGS. 1 and 2 in order to show the internal components of the present invention.) The reel 10 is supported by a first and a second brace 16 and 18, with its axle 20 disposed horizontally (FIG. 5). The braces 16 and 18 are in turn secured within the housing 12, e.g., within tracks 22 and 24, which provide for the removal of the reel assembly 10 for maintenance and repair, if required. (The top 26 of the housing 12 may be removed to provide access to the interior of the housing 12, as required.)

A water supply line 28 is provided below grade, and passes through the side of the housing 12 to the hose reel 10 and is connected directly to the water inlet end 30 of the hose 32 by means of a rotating fitting 34, as shown in FIG. 5. The hose 32 is extendibly wound upon the reel 10, with the hose 32 and its water outlet end 36 passing through a hose access and control panel 38 which is accessible at grade in the surface S of the terrain, by means of a control box 39 enclosing the control panel 38 and sealed to the top 26 of the housing 12. A lid or cap 40 may be hinged or otherwise secured to the top of the control box 39, which lid 40 preferably provides a weather tight seal for the control panel 38 and underlying reel 10 and housing 12, and is preferably located at grade, generally coplanar with the surface S, in order to permit mowing and, other yard work to be accomplished thereover without impedance.

Figure 4:
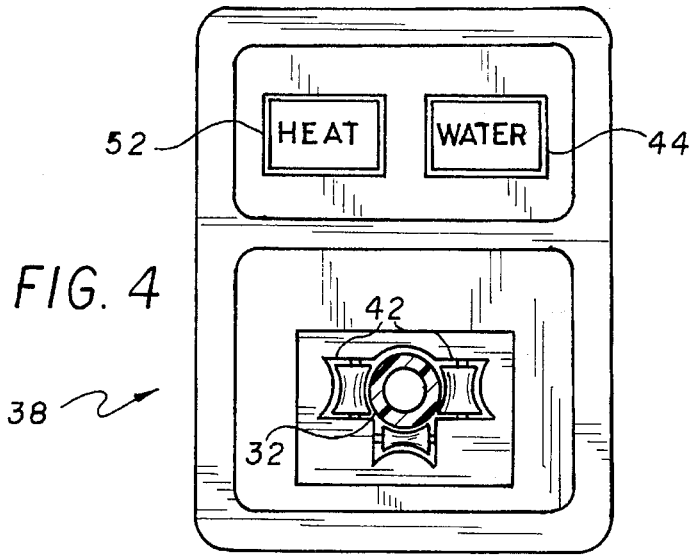
FIG. 4 is a detail view of the control panel for the operation of remotely actuated water and heat controls for the present reel.
Figure 6:
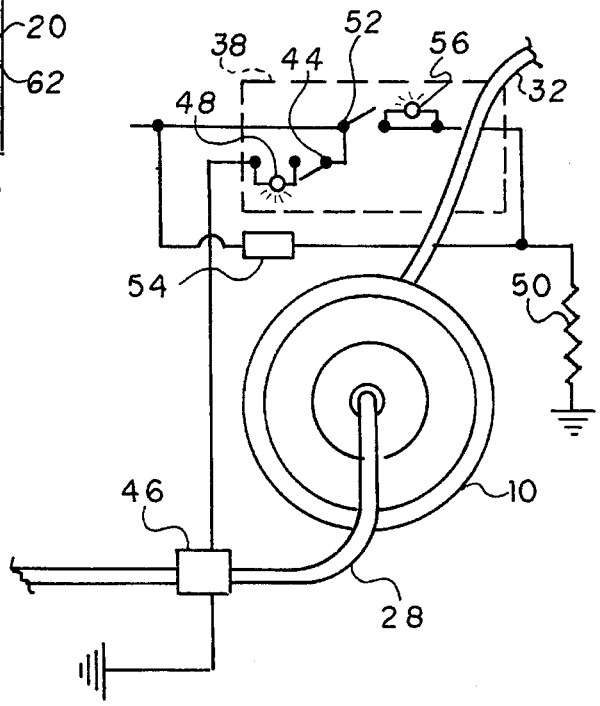
FIG. 6 is an electrical schematic diagram for the remote operation of the features of the present hose reel.

The access and control panel 38 may include control functions in addition to the hose outlet and guide roller assembly 42, as shown more clearly in the detail view of the control panel 38 shown in FIG. 4. A remote control button 44 or other type of electrical switch may be provided, serving to actuate an electrical water shutoff solenoid valve 46, opening the solenoid valve 46 when the button 44 is activated. A light 48 (shown in the electrical schematic of FIG. 6) may be used to illuminate the button 44 when the valve has been opened, if desired.

In addition, an electric heating element 50 may be provided within the reel housing 12, if desired, to prevent any residual water which may remain within the hose 32 after water shutoff, from freezing therein and damaging the hose 32 or other components. The heating element 50 may be activated by a manual switch 52 (FIGS. 4 and 6) or by means of an automatic thermostat 54. As in the case of the water solenoid valve 46, a heating element light 56 (FIG. 6) may be provided in or with the heating element switch 52 in order to indicate activation thereof. It will be noted that the electrical control panel portion of the control panel 38 is raised above the hose outlet 42, in order to better protect the electrical switches from moisture; preferably, waterproof components are used for any electrical devices used in the present invention.

Figure 3:
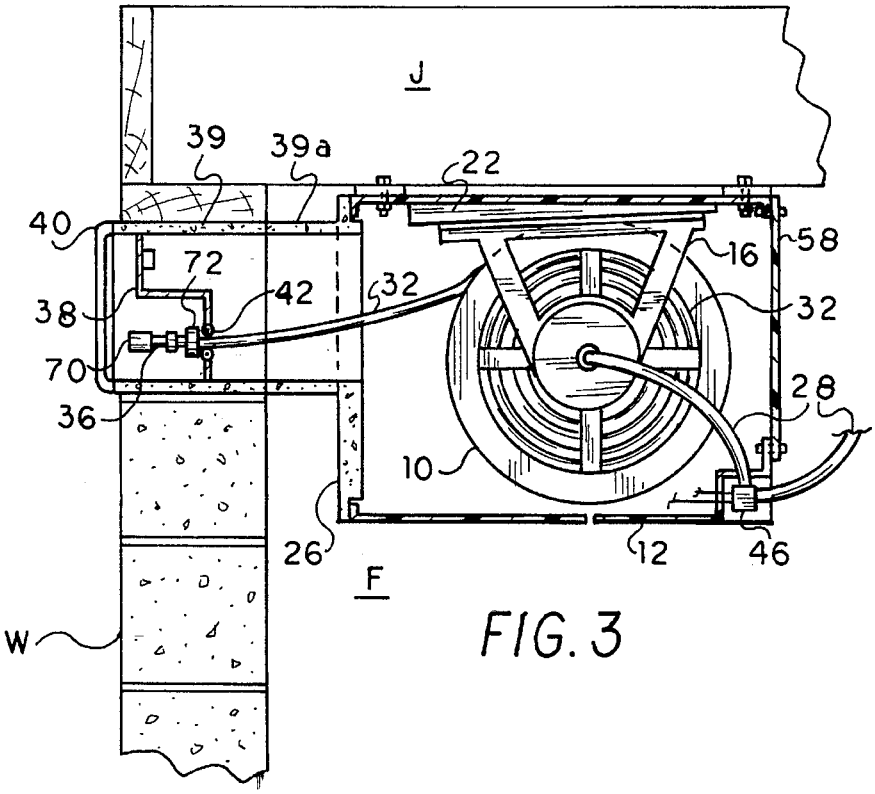
FIG. 3 is a side elevation view of the present hose reel and housing, in a basement or crawl space installation.

FIG. 3 provides an elevational view in section of an alternative embodiment of the present concealed hose reel invention, with the housing 12 being installed beneath the floor joists J in a foundation space F (e.g., basement or foundation crawl space). Most of the components, i.e., reel 10, reel brace 16 and track 22, hose 32, water supply line 28, etc., are identical to those components of the buried embodiment of FIGS. 1 and 2.

However, as the housing 12 is not buried in a surrounding matrix of earth, access to the interior thereof may be provided by means of an optional removable access panel 58 which is bolted or otherwise temporarily fastened to one side of the housing 12. (The access panel 58 may not be required in a basement installation, but can be of value in retaining heat from any electric heater 50 which may be installed within the housing 12.) With the hose 32 being accessed through the wall W of the structure, rather than at the surface of the overlying terrain as shown in FIGS. 1 and 2, an optional extension 39*a* may be required to allow for the thickness of the wall W, in order to place the lid 40 of the control box 39 essentially flush with the outer surface of the wall W. Otherwise, the two embodiments are essentially identical, as noted above.

FIG. 5 provides a view of the hose retraction means for the present reel 10. In FIG. 5, a fixed retraction assembly 60 is provided at one side of the rotating reel 10, with a retraction device, such as the elastic bungee cord 62, secured thereto. A fixed end 64 of the cord 62 is secured to the fixed retraction assembly 60, with the cord 62 being stretched and wound around a rotating central drum 66. The opposite end 68 of the cord 64 is secured to the drum 66, with the drum 66 also being affixed to the axle 20 of the reel 10. Thus, as the hose 32 is unwound from the reel 10, the cord 62 is stretched further, thereby producing a retraction torque on the reel 10 to draw the hose 32 back onto the reel 10 when use of the hose 32 is completed. (A manual or automatic reel locking means to secure the reel 10 with the hose 32 extended therefrom, may be provided as desired.) It will be seen that other retraction means, e.g., coil springs or even weights, may be used as desired.

In summary, the present concealed hose reel mechanism provides an excellent means of protecting and storing a garden hose or the like, while at the same time providing ready access to such a hose. The reel and housing may be installed within the ground, or alternatively within the foundation space of a structure as desired.

When use of the hose is desired, the user need only open the control panel lid and withdraw the hose from the access and control panel as desired. (As noted above, some form of reel locking means may be provided in order to preclude need for constant tension on the hose to overcome the retraction means described above, if desired.) If additional hose is required, another hose (not shown) may be connected to the end 36 of the hose 32 by means of an automatic cutoff and quick disconnect or other suitable fitting 70 shown in FIGS. 1 through 3.

At this point, the user need only push the water flow control switch button 44 in order to open the solenoid valve 46 to allow water to flow. When the watering operation is completed, shutting off the switch 44 will shut off electrical power to the solenoid and close the valve 46 to shut off water flow. (As noted further above, an additional manually or automatically activated electrical heating element may also be provided for freezing climates, if desired.) The hose 32 may then be retracted back onto the reel 10, with the end 36 of the hose being captured within the control panel 38 for later access by means of the hose stop 72. The panel door or lid 40 may then be closed to seal the interior of the panel 38 area and housing 12, to assure readiness for the next use.

It is to be understood that the present invention is not limited to the sole embodiments described above, but encompasses any and all embodiments within the scope of the following claims.

I claim:

1. A concealed hose reel, comprising:

a stationary, concealed, permanently installed enclosed hose reel housing;

a hose reel having a horizontally disposed axis and installed within said housing;

a hose extendibly wound upon said hose reel, with said hose having a reel attachment and a water inlet end secured directly to a water supply line and an opposite distal water outlet end;

an accessible hose access and control panel extending from said housing, said access and control panel at least including a passage therethrough providing for the retractable extension of at least a substantial portion of said hose therefrom, and;

an automatic retraction means for said hose, wherein said automatic retraction means comprises an elastic cord, whereby;

said hose is extended from said hose access and control panel from said hose reel within said concealed housing as desired, and retracted through said hose access and control panel and upon said hose reel for protected storage of said hose when use of said hose is completed.

2. The hose reel of claim 1, including:

a remotely actuated water control valve disposed within said housing and controlling water flow through said water supply line.

3. The hose reel of claim 2, wherein:

said remotely actuated water control valve is an electrically actuated solenoid valve, and said hose access and control panel includes control means for said solenoid valve.

4. The hose reel of claim 1, wherein:

said housing includes electrical heating means therein.

5. The hose reel of claim 1, wherein:

at least said hose reel is removable from said housing, for maintenance and repair of at least said hose reel and said hose.

6. An underground hose reel, comprising:

a stationary, enclosed hose reel housing permanently installed completely beneath the surface of the ground;

a hose reel having a horizontally disposed axis and installed within said housing;

a hose extendibly wound upon said hose reel, with said hose having a reel attachment and a water inlet end secured directly to a water supply line and an opposite distal water outlet end;

a surface mounted hose access and control panel extending from said housing, said access and control panel at least including a passage therethrough providing for the retractable extension of at least a substantial portion of said hose therefrom, and;

an automatic retraction means for said hose, wherein said automatic retraction means comprises an elastic cord, whereby;

said hose is extended from said hose access and control panel from said hose reel within said underground housing as desired, and retracted through said hose access and control panel and upon said hose reel for protected storage of said hose when use of said hose is completed.

7. The hose reel of claim 6, including:

a remotely actuated water control valve disposed within said housing and controlling water flow through said water supply line.

8. The hose reel of claim 7, wherein:

said remotely actuated water control valve is an electrically actuated solenoid valve, and said hose access and control panel includes control means for said solenoid valve.

9. The hose reel of claim 6, wherein:

said housing includes electrical heating means therein.

10. The hose real of claim 6, wherein:

at least said hose reel is removable from said housing, for maintenance and repair of at least said hose reel and said hose.

11. An internal hose reel, comprising:

a stationary, enclosed hose reel housing permanently installed internally within the foundation space of a building structure;

a hose reel having a horizontally disposed axis and installed within said housing;

a hose extendibly wound upon said hose reel, with said hose having a reel attachment and a water inlet end secured directly to a water supply line and an opposite distal water outlet end;

a wall mounted externally accessible hose access and control panel extending from said housing, said access and control panel at least including a passage therethrough providing for the retractable extension of at least a substantial portion of said hose therefrom, and;

an automatic retraction means for said hose, wherein said automatic retraction means comprises an elastic cord, whereby;

said hose is extended from said externally accessible hose access and control panel from said hose reel within said foundation space internally installed housing as desired, and retracted through said hose access and control panel and upon said hose reel for protected storage of said hose when use of said hose is completed.

12. The hose reel of claim 11 including:

a remotely actuated electrical solenoid water control valve disposed within said housing and controlling water flow through said water supply line, and control means for said water control valve disposed within said hose access and control panel.

13. The hose reel of claim 11, wherein:

said housing includes electrical heating means therein.

14. The hose reel of claim 11, wherein:

at least said hose reel is removable from said housing, for maintenance and repair of at least said hose reel and said hose.

* * * * *